US009107468B1

(12) United States Patent
Xiong

(10) Patent No.: US 9,107,468 B1
(45) Date of Patent: Aug. 18, 2015

(54) TEMPERATURE CONTROLLED ELECTRIC SHOE

(71) Applicant: Cher Xiong, St. Paul, MN (US)

(72) Inventor: Cher Xiong, St. Paul, MN (US)

( * ) Notice: Subject to any disclaimer, the term of this patent is extended or adjusted under 35 U.S.C. 154(b) by 404 days.

(21) Appl. No.: 13/668,562

(22) Filed: Nov. 5, 2012

(51) Int. Cl.
*A43B 7/04* (2006.01)
*A43B 7/06* (2006.01)
*A43B 7/02* (2006.01)

(52) U.S. Cl.
CPC ... *A43B 7/02* (2013.01); *A43B 7/04* (2013.01); *A43B 7/06* (2013.01)

(58) Field of Classification Search
CPC ..... A43B 7/02; A43B 7/025; A43B 7/04; A43B 7/06; A43B 7/08; A43B 7/082; A43B 7/087; A43B 3/0015
USPC ..... 290/1 C; 36/2.6, 3 B, 3 R; 219/211
See application file for complete search history.

(56) References Cited

U.S. PATENT DOCUMENTS

| | | | | |
|---|---|---|---|---|
| 1,506,282 | A * | 8/1924 | Barbieri | 310/75 B |
| 4,674,199 | A * | 6/1987 | Lakic | 36/2.6 |
| 4,837,494 | A | 6/1989 | Maier | |
| 5,167,082 | A * | 12/1992 | Chen | 36/2.6 |
| 5,375,345 | A * | 12/1994 | Djuric | 36/3 B |
| 5,495,682 | A * | 3/1996 | Chen | 36/2.6 |
| 5,826,349 | A * | 10/1998 | Goss | 36/3 R |
| 6,201,314 | B1 | 3/2001 | Landry | |
| 6,230,501 | B1 * | 5/2001 | Bailey et al. | 62/51.1 |
| 6,370,799 | B1 * | 4/2002 | Thatcher | 36/3 B |
| 6,724,105 | B2 * | 4/2004 | Chen | 310/20 |
| 7,219,449 | B1 * | 5/2007 | Hoffberg et al. | 36/88 |
| 7,510,293 | B2 | 3/2009 | Chyn | |
| 8,087,409 | B2 * | 1/2012 | Kung | 126/204 |
| 8,919,011 | B2 * | 12/2014 | Byrne | 36/3 R |
| 2007/0068037 | A1 * | 3/2007 | Ridinger | 36/3 B |
| 2011/0107771 | A1 * | 5/2011 | Crist et al. | 62/3.3 |
| 2012/0005919 | A1 * | 1/2012 | Chen | 36/2.6 |
| 2012/0049538 | A1 * | 3/2012 | Periasamy et al. | 290/1 C |
| 2012/0260522 | A1 * | 10/2012 | Shi et al. | 36/2.6 |
| 2012/0260531 | A1 * | 10/2012 | Shi et al. | 36/102 |
| 2013/0219743 | A1 * | 8/2013 | Ye | 36/2.6 |
| 2013/0247410 | A1 * | 9/2013 | Tseng | 36/2.6 |
| 2014/0059882 | A1 * | 3/2014 | Lupinek et al. | 36/2.6 |

FOREIGN PATENT DOCUMENTS

| | | | | |
|---|---|---|---|---|
| WO | 2008-108551 | * | 9/2008 | A43B 7/04 |

* cited by examiner

*Primary Examiner* — Burton Mullins
(74) *Attorney, Agent, or Firm* — Crossley Patent Law

(57) ABSTRACT

A temperature controlled electric shoe that includes a generator configured to convert the kinetic energy of ambulation into electrical energy by means of a compressible heel section moving between a compressed position and a decompressed position, wherein a crank gear rotationally engages a spindle gear to rotate a circular magnet about a copper coil, whereby electrical energy is storable by means of a battery, said electrical energy therefore usable to heat a toe cap disposed within the shoe and power extant electronic accoutrements interconnected to the shoe by means of a plug connect, and wherein the compressible heel section further forces airflow selectively into the shoe interior, as desired, and alternately vents said airflow exteriorly to the shoe when a switch-valve is moved between a first valve position and a second valve position and a person wearing the shoe perambulates.

7 Claims, 9 Drawing Sheets

TEMPERATURE CONTROLLED ELECTRIC SHOE

BACKGROUND OF THE INVENTION

Various types of shoes are known in the prior art. However, what is needed is a temperature controlled electric shoe that includes a generator configured to convert the kinetic energy of ambulation into electrical energy by means of a compressible heel section moving between a compressed position and a decompressed position, wherein a crank gear rotationally engages a spindle gear to rotate a circular magnet about a copper coil, whereby electrical energy is storable by means of a battery, said electrical energy therefore usable to heat a toe cap disposed within the shoe and power extant electronic accoutrements interconnected to the shoe by means of a plug connect, and wherein the compressible heel section further forces airflow selectively into the shoe interior, as desired, and alternately vents said airflow exteriorly to the shoe when a switch-valve is moved between a first valve position and a second valve position and a person wearing the shoe ambulates.

FIELD OF THE INVENTION

The present invention relates to a temperature controlled electric shoe, and more particularly, to a temperature controlled electric shoe that includes a generator configured to convert the kinetic energy of ambulation into electrical energy by means of a compressible heel section moving between a compressed position and a decompressed position, wherein a crank gear, moved between a first position and a second position, rotationally engages a spindle gear to rotate a circular magnet about a copper coil, whereby electrical energy is storable by means of a battery, said electrical energy therefore usable to heat a toe cap disposed within the shoe and power extant electronic accoutrements interconnected to the shoe by means of a plug connect, and wherein the compressible heel section further forces airflow selectively into the shoe interior, as desired, and alternately vents said airflow exteriorly to the shoe when a switch-valve is moved between a first valve position and a second valve position and a person wearing the shoe ambulates.

SUMMARY OF THE INVENTION

The general purpose of the temperature controlled electric shoe, described subsequently in greater detail, is to provide a temperature controlled electric shoe which has many novel features that result in a temperature controlled electric shoe which is not anticipated, rendered obvious, suggested, or even implied by prior art, either alone or in combination thereof.

The present invention has been devised to transform the kinetic energy of a person ambulating to electrical energy, whereby a shoe is temperature controllable and extant portable electronic devices (such as an MP3 player, for example, a fan, or other device) may be powered by means of a rechargeable battery disposed in said shoe.

The present temperature controlled electric shoe includes a generator disposed upon the heel counter of the shoe, said generator in operational communication with a compressible heel section disposed upon the shoe. When a person wearing the shoe ambulates, the compressible heel section is moved between a compressed position and a decompressed position. Such movement moveably engages a crank gear disposed within the generator which crank gear, in turn, rotatably engages a circular magnet disposed about a copper coil. The rotational movement of the magnet generates a potential difference in the coil, and kinetic energy of the wearer ambulating is therefore transformed into electrical energy storable within a battery disposed within the shoe in circuit with the generator.

The generator includes the crank gear operationally driven by the movement of the compressible heel section between the compressed position and the decompressed position. The crank gear includes a crenate edge disposed to moveably engage with a spindle gear. The spindle gear includes a plurality of spindle arms disposed radially therefrom. When the crank gear is moved from a first position to a second position, as when the heel section is compressed, the spindle gear is rotated in a first direction and each of the plurality of spindle arms is caused to engage with the crenate inner circumference disposed on the magnet. When the crank gear is moved from the second position to the first position, as when the heel section is decompressed, the spindle gear is rotated in a second direction and each of the plurality of spindle arms is caused to disengage from the inner circumference of the magnet.

Potential difference generated by said rotational movement of the magnet about the copper coil is transferred to the battery where it is stored in the chemical energy of the battery. The battery is disposed in circuit with a toe cap and a plug connect. The toe cap may be heated when a temperature control, disposed on the shoe, is activated or moved to a particular temperature setting, whereby a users feet may be warmed. The plug connect is configured to interconnect with plugs disposed on extant electronic devices, such as a cell phone, an MP3 player, an electric fan, among other such devices as may be interconnected therewith.

Therefore, in use, a person applies weight to the compressible heel section while ambulating, whereupon the heel section is moved to the compressed position. When weight is removed from the heel section during regular ambulation, a spring member disposed within the heel section forces the heel section to the decompressed position. Thusly, the heel section is alternately compressed and decompressed with every step a person wearing the shoe takes, and the kinetic energy of this movement is converted by means of the generator to electrical energy storable within the battery and usable to power portable electronic devices interconnected with the plug connect and also to heat the toe cap, as desired.

To cool the shoe interior during hot weather or in hot environments an air channel is disposed within the heel counter, the sole, and the midsole of the shoe. The air channel is in baric communication with the compressible heel section. Thus, when the heel section is compressed, and the volume of the heel section is thereby decreased, air within the air channel is directionally forced through the air channel, said airflow controlled by means of a one-way valve disposed in an air intake and a two-way valve disposed proximal the heel section.

When the heel section is decompressed, the volume of the heel section is increased and a partial vacuum is created in the air channel. Air is thusly forced into the air intake, disposed in the heel counter of the shoe, through a one-way valve, and into the heel section. When the heel section is subsequently compressed, said air is then forced through the two-way valve to vent into the shoe interior through an air outlet disposed proximal a user's toes.

The two-way valve permits unidirectional air flow with respect to the heel section, but is controllable by means of a switch-valve disposed on the exterior of the shoe to alternately vent air into the shoe interior, through the air outlet, and alternately exteriorly to the shoe, through an air vent. When the switch-valve is moved to an open position, the two-way valve is configured to a first vent position to route air forced from the heel section to vent interiorly to the shoe through the air outlet. When the switch-valve is moved to a closed position, the two-way valve is configured to a second vent position and air forced from the heel section is routed through an air vent to the shoe exterior. Thus, air drawn into the heel section may be bypassed from the shoe interior when the switch-valve is moved to the closed position, as desired, and vented exteriorly.

The temperature controlled electric shoe is therefore usable to warm a user's feet in cold climates and environments and, alternately, to vent air into the shoe interior in hot climates and environments. The generator also enables the powering of portable electronic accoutrements, as desired.

Thus has been broadly outlined the more important features of the present temperature controlled electric shoe so that the detailed description thereof that follows may be better understood and in order that the present contribution to the art may be better appreciated.

Objects of the present temperature controlled electric shoe, along with various novel features that characterize the invention are particularly pointed out in the claims forming a part of this disclosure. For better understanding of the temperature controlled electric shoe, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
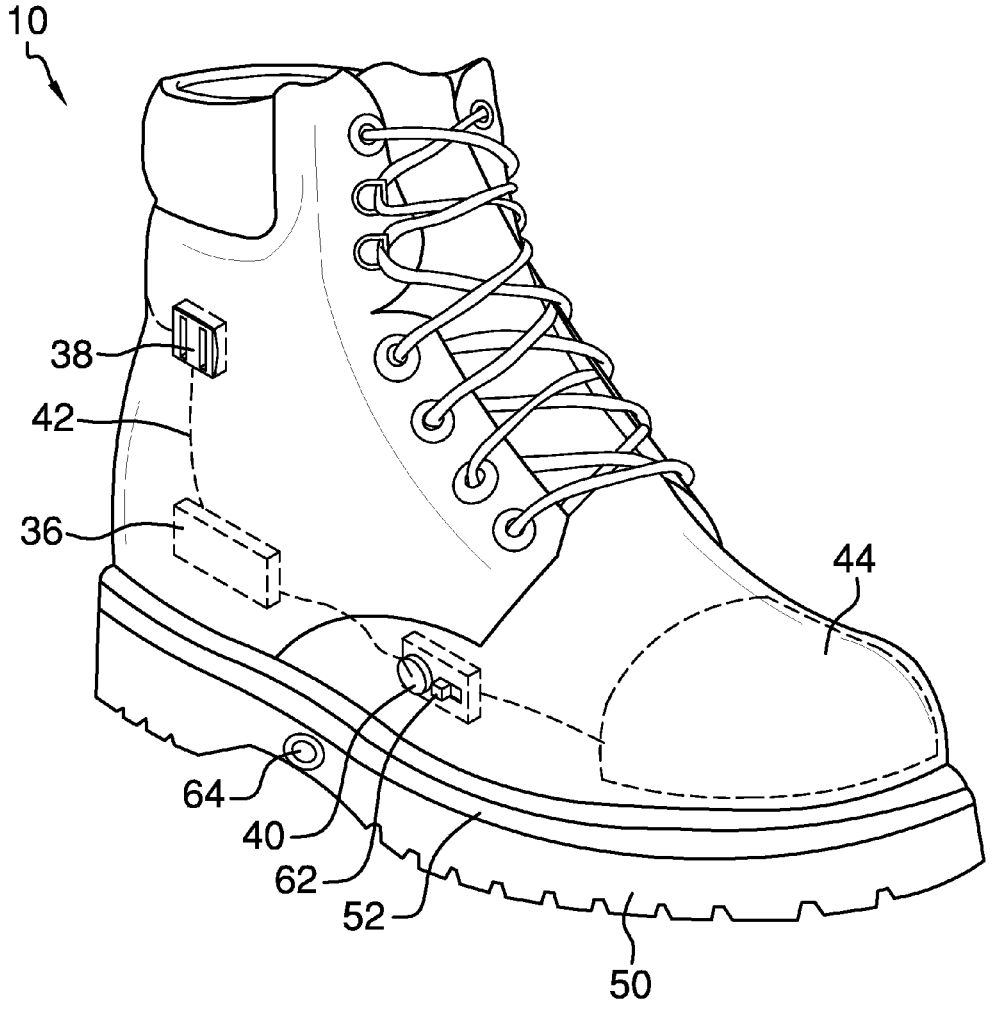
FIG. 1 is an isometric view.
Figure 2:
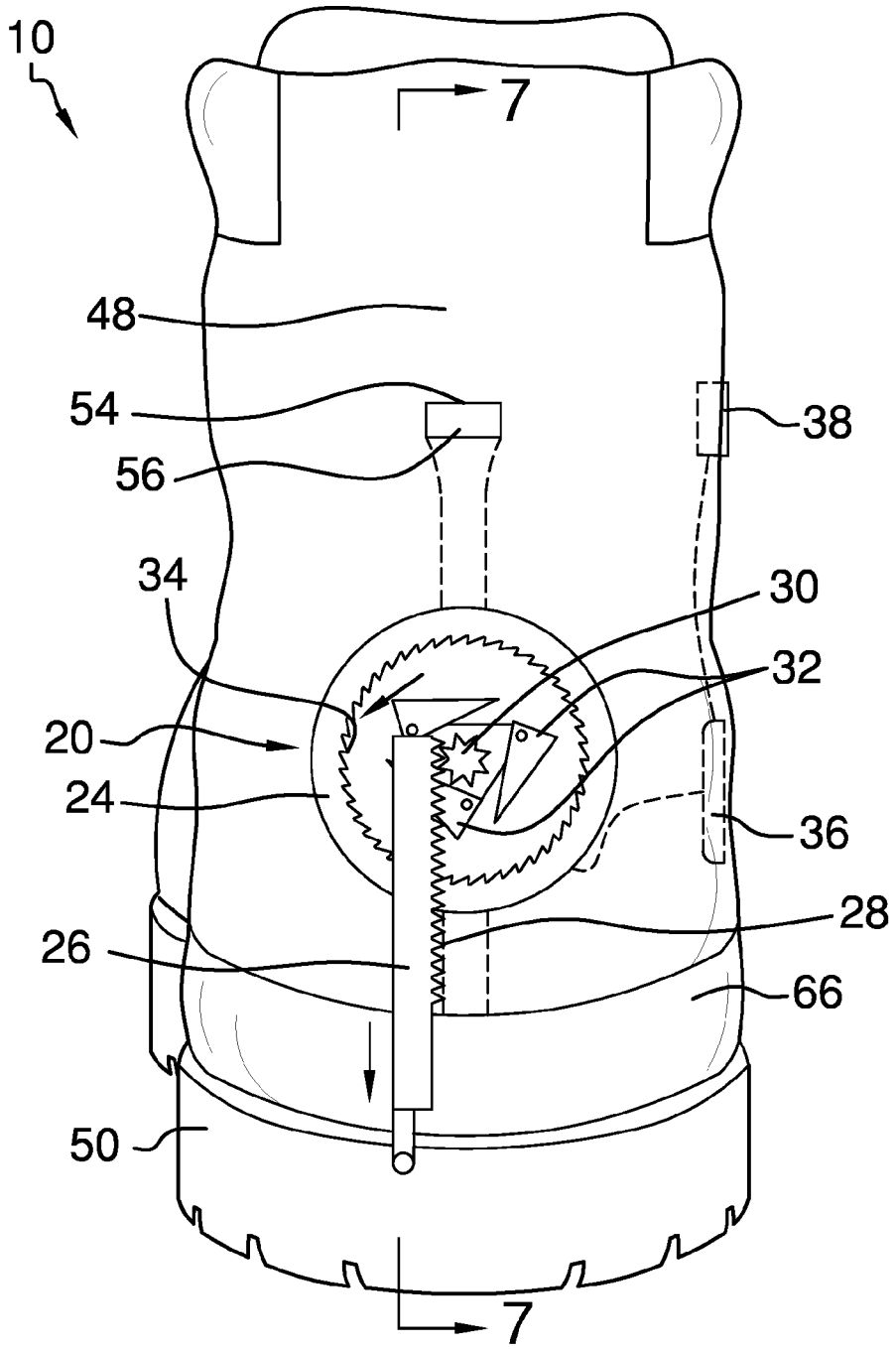
FIG. 2 is a rear view with a crank gear in a first position.
Figure 3:
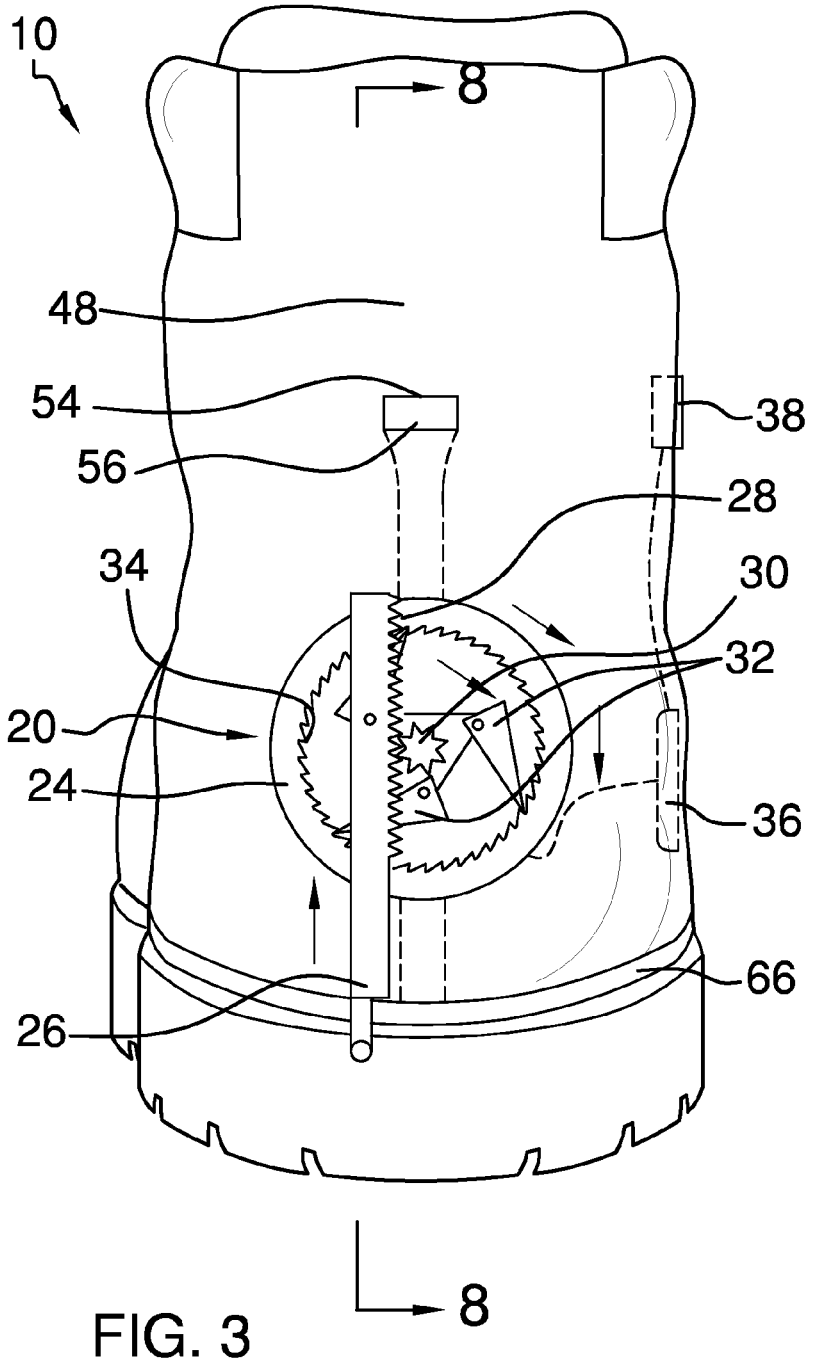
FIG. 3 is a rear view with the crank gear in a second position.
Figure 4:
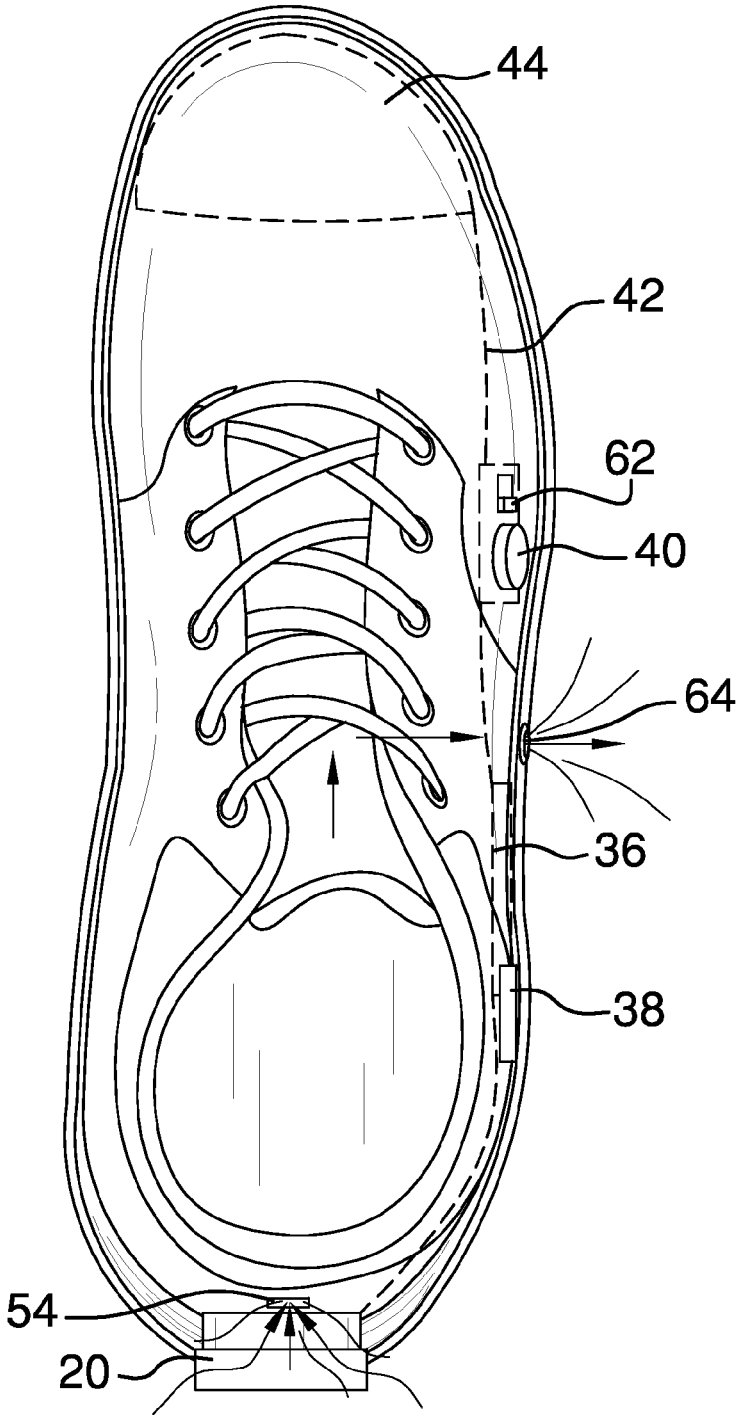
FIG. 4 is a top view.
Figure 5:
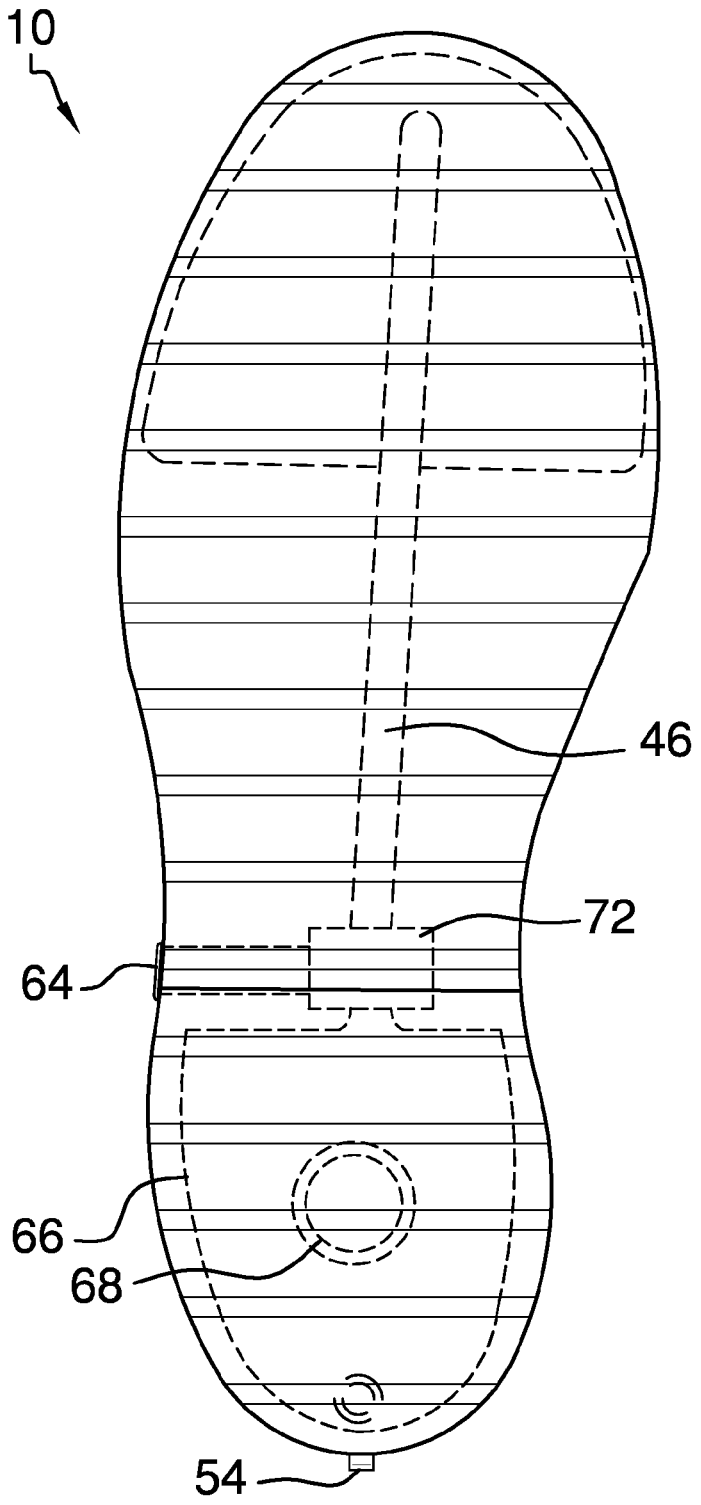
FIG. 5 is a bottom view.
Figure 6:
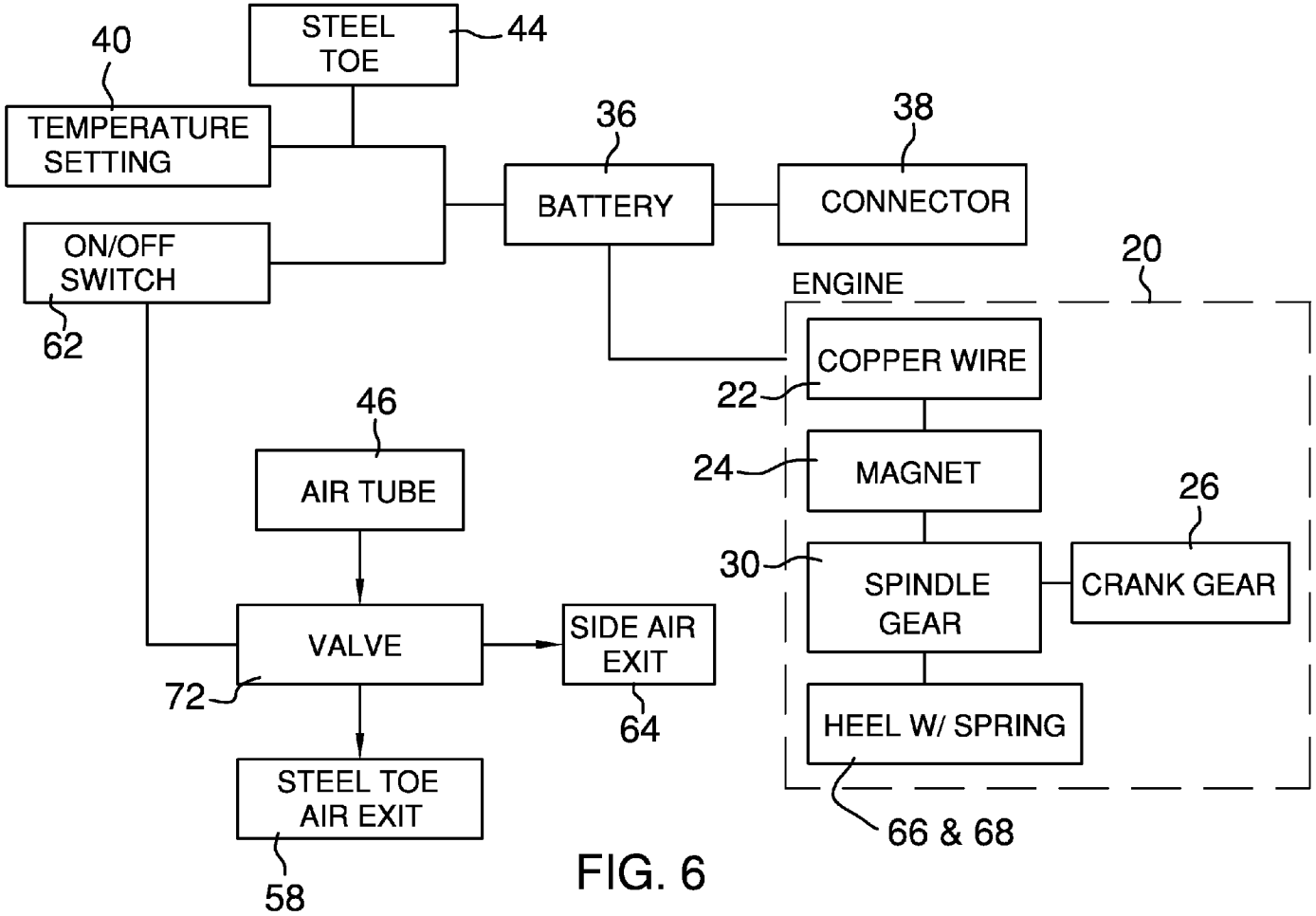
FIG. 6 is a block diagram of the electrical system.

With reference now to the drawings, and in particular FIGS. 1 through 6 thereof, example of the instant temperature controlled electric shoe employing the principles and concepts of the present temperature controlled electric shoe and generally designated by the reference number 10 will be described.

Referring to FIGS. 1 through 6 a preferred embodiment of the present temperature controlled electric shoe 10 is illustrated.

The temperature controlled electric shoe 10 has been devised to enable a person wearing said shoe 10 to control the temperature of the shoe 10 to keep their feet warm when the ambient environment is cold, or to vent the shoe 10 for cooling when the ambient environment is hot. The present temperature controlled electric shoe 10 also is provided with means for generating electricity whereby kinetic energy is transformed into electrical energy usable for heating the shoe 10 or charging a battery 36 for use with extant portable electronics (not shown), as will be described subsequently.

The temperature controlled electric shoe 10 includes a generator 20 for converting kinetic energy into electrical energy when a person wearing the shoe 10 ambulates. The generator 20 includes a copper coil 22 and a magnet 24 rotatably disposed about the copper coil 22. A crank gear 26 is disposed in operational communication with the magnet 24. When the person wearing the shoe 10 ambulates, the crank gear 26 rotates the magnet 24 about the copper coil 22 and a potential difference is generated, as will be described subsequently.

A battery 36 is in circuit with the generator 20 to store the electrical energy for use when the person wearing the shoe 10 is sedentary. To power extant small electronic devices (not shown), as desired, a plug connect 38 is disposed on the exterior of the shoe 10, said plug connect 38 in circuit with the battery 36 and usable to interconnect extant electronics (not shown) in circuit with the battery 36. Such portable electronics may include portable music playing devices (such as MP3 players, for example), cell phones, electric fans, and other portable electronic devices, as desired.

A temperature control switch 40 is disposed in circuit with the battery 36, said temperature control switch 40 disposed upon the exterior of the shoe 10. A plurality of wiring 42 is in circuit with the temperature control switch 40, said plurality of wiring 42 interconnecting with a toe cap 44 disposed within the shoe 10. The plurality of wiring 42 conducts a current from the battery 36 to the toe cap 44 and the toe cap 44 is thereby warmed to a particular temperature, as desired, said temperature controllable by means of the temperature control switch 40.

An air channel 46 is disposed through the heel counter 48 of the shoe 10, the sole 50, and the midsole 52. An air intake 54 is disposed in open communication with the air channel 46, said air intake 54 disposed on the rear of the heel counter 48. The air intake 54 includes a one way valve 56 disposed therein, whereby air flow into the shoe 10 is unidirectional. The one way valve 56 inhibits airflow out of the air intake 54 while enabling airflow into the air channel 46 through the air intake 54.

At least one air outlet 58 is disposed in open communication with the air channel 46, said air outlet 58 disposed within the insole 60 of the shoe 10. In the preferred embodiment herein illustrated, at least one air outlet 58 is disposed within the insole 60 proximal to the toe cap 44. Air introduced into the air channel 46 is vented through the at least one air outlet 58 during ambulation, as will be described subsequently.

A switch-valve 62 is disposed upon the side of the shoe 10, said switch-valve 62 manually operable between an open position and a closed position, to engage a two-way valve 72, disposed in the air channel 46, between a first vent position and a second vent position. Air is vented alternately through the at least one air outlet 58 and an air vent 64 when the switch-valve 62 is moved between the respective first vent position and the second vent position. When air is vented out of the air vent 64, air is not vented into the shoe 10 interior by means of the at least one air outlet 58. Thusly, airflow may be bypassed through the sole 50 and out the air vent 64 without said air being forced into the shoe 10 interior, as desired.

To power the temperature controlled electric shoe 10 and provide means by which air is drawn into and forced out of the air channel 46, a compressible heel section 66 is disposed in the sole of the shoe 10. The compressible heel section 66 is in baric communication with the air channel 46. The compressible heel section 66 is compressible when a person wearing said shoe 10 ambulates. The compressible heel section 66 is compressible between a compressed position and a decompressed position. When a user places weight upon the compressible heel section 66, as when ambulating, for example, the compressible heel section 66 compresses into the compressed position, the volume of the air channel 46 is decreased, and air within the air channel 46 is forced out the at least one air outlet 58 or, when the switch-valve 62 is moved to the closed position and the two-way valve engaged in the second vent position, out the air vent 64, as desired.

Figure 7:
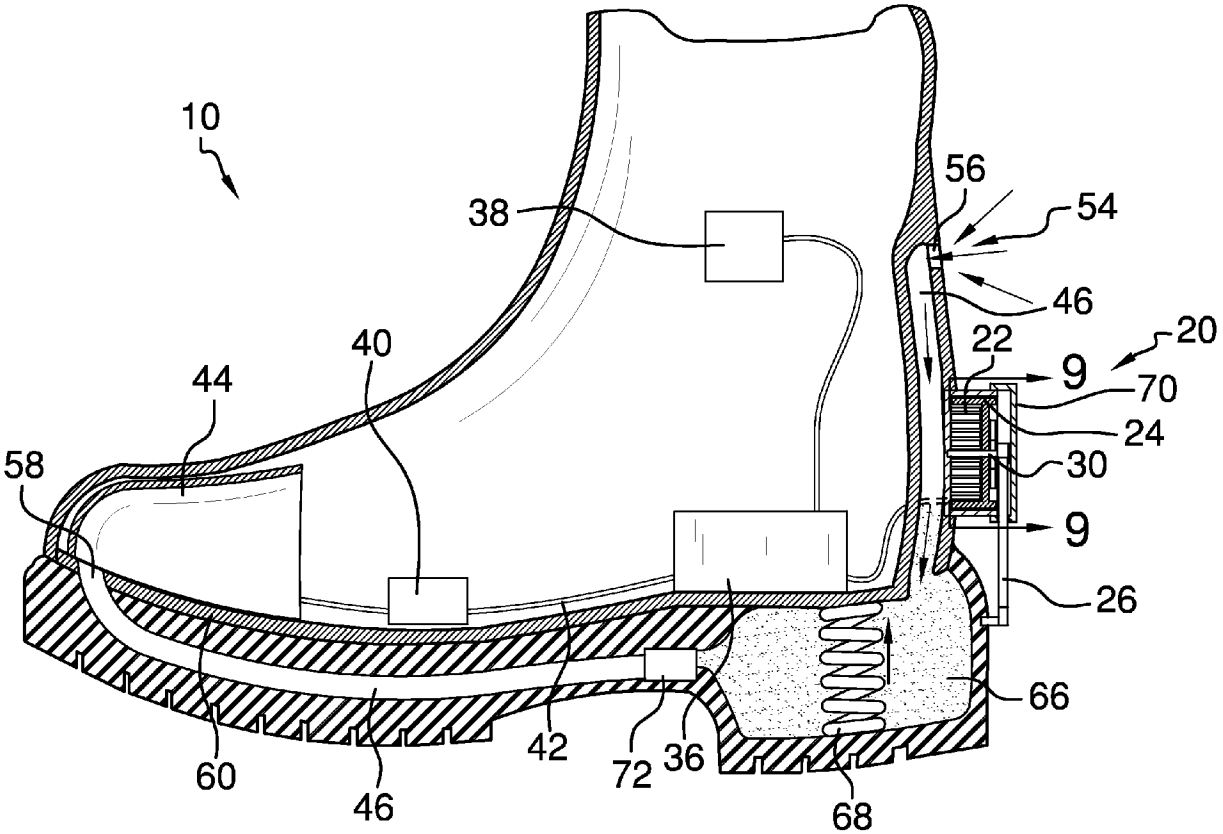
FIG. 7 is cross-section view taken along the line 7-7 of FIG. 2.
Figure 8:
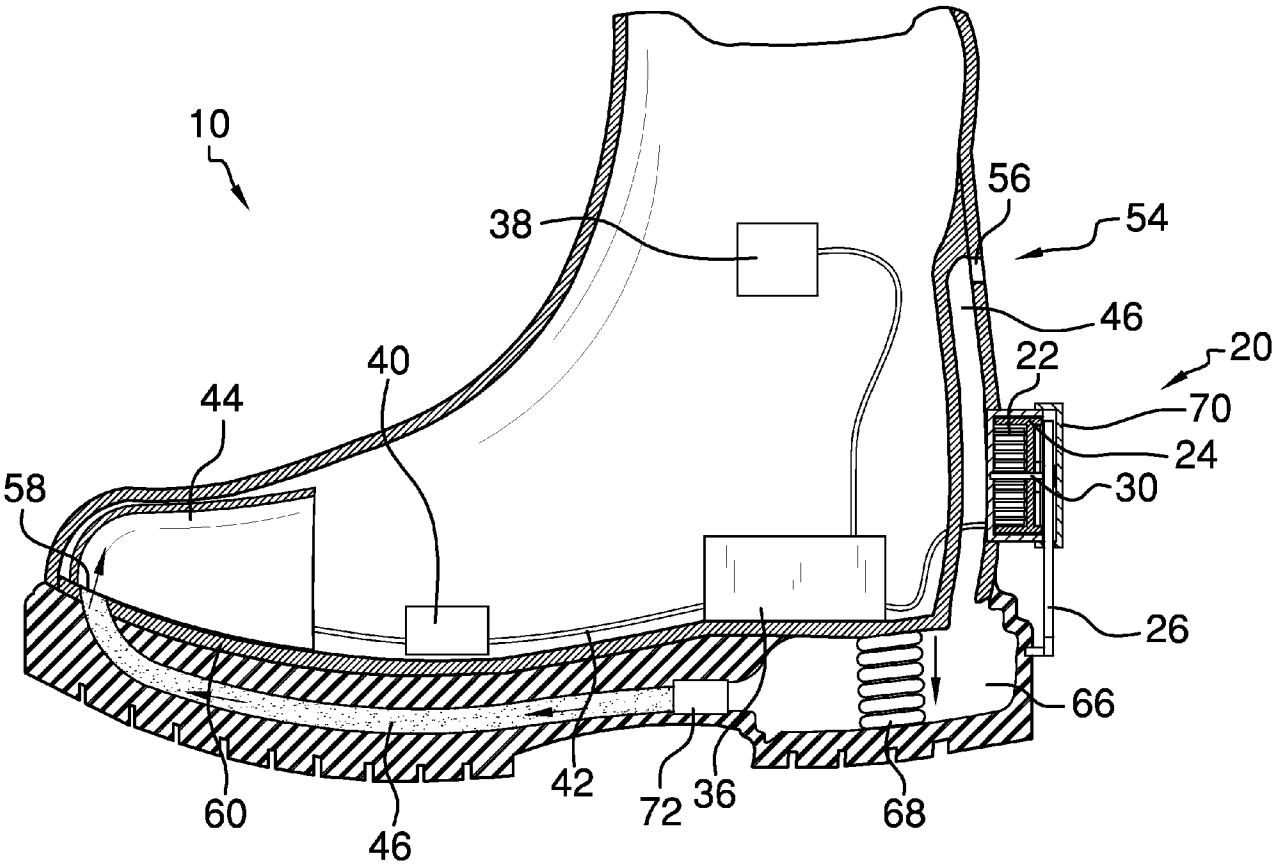
FIG. 8 is a cross-section view taken along the line 8-8 of FIG. 3.
Figure 9B:
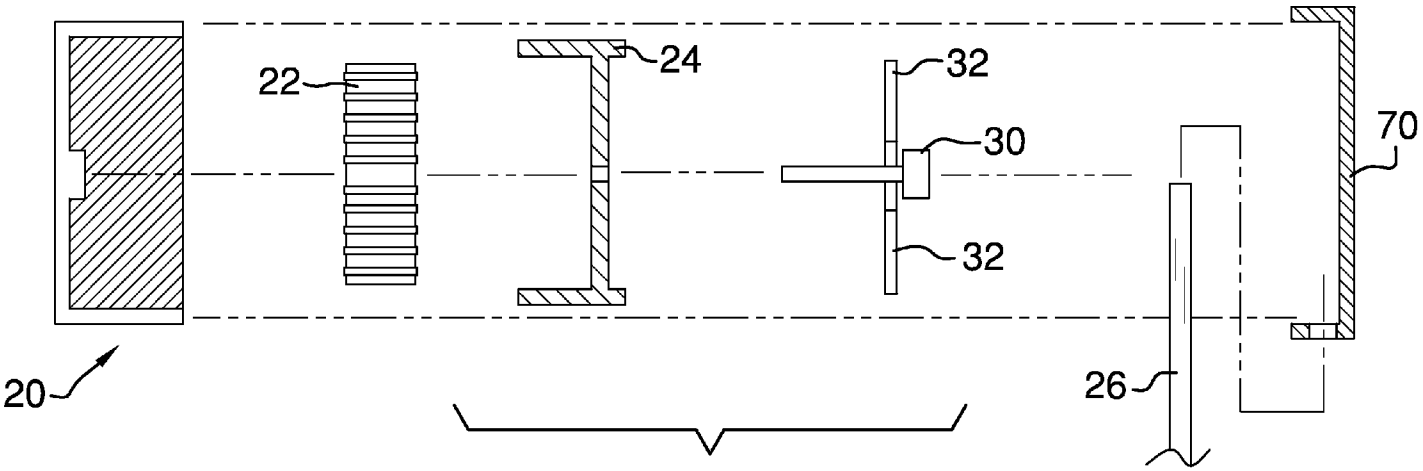
FIG. 9B is a side exploded view of the cross-section taken across the line 9-9 of FIG. 7.
Figure 9A:
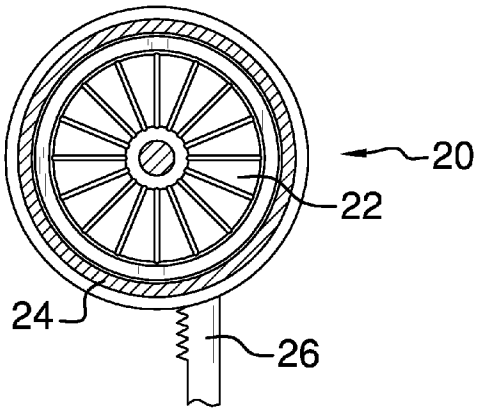
FIG. 9A is a cross section view of the generator taken along the line 9-9 of FIG. 7.

When said person lifts the shoe 10, as when ambulating, for example, and weight is removed from the compressible heel section 66, a spring member 68 disposed within the compressible heel section 66 forces the compressible heel section 66 back into the decompressed position. When the compressible heel section 66 is forced back into the decompressed position, the volume of the heel section 66 is increased and a partial vacuum is created within the air channel 46. Air is resultantly forced into the air channel 46 through the one-way valve 56 disposed in the air intake 54 to fill the partial vacuum (see FIG. 7). Said air is then forced through the two-way valve 72 disposed in the air channel 46 proximal the compressible heel section 66 and then subsequently expelled from the air outlet 58, or alternately the air vent 64 when the switch-valve 62 is in the closed position, as previously described, when the compressible heel section 66 is again moved to the compressed position, as with a subsequent step taken by the person wearing the present temperature controlled electric shoe 10 (see FIG. 8).

The compressible heel section 66 also provides means for rotatably engaging the generator 20. The crank gear 26 is moved upwardly to a second position when the compressible heel section 66 is moved to the compressed position (see FIG. 3), and the crank gear 26 is then moved downwardly to a first position when the compressible heel section 66 is moved to the decompressed position (see FIG. 2). The crank gear 26 is thus moveably engaged by means of the compressible heel section 66.

The crank gear 26 includes a crenate edge 28 which rotationally engages a spindle gear 30 disposed upon the magnet 24. When the crank gear 26 is moved to the second position, the upward motion of the crank gear 26 is transferred to rotational movement of the spindle gear 30 in a first direction. When the spindle gear 30 is moved in the first direction, each of a plurality of spindle arms 32 are caused to engage with a crenate interior circumference 34 disposed upon the magnet 24, and the magnet 24 is caused to rotate thereby. When the heel section 66 is subsequently moved to the decompressed position by action of the spring member 68 disposed therein, the crank gear 26 is returned to the first position and the spindle gear 30 is rotated in a second direction. When the spindle gear 30 rotates in the second direction, each of the plurality of spindle arms 32 is disengaged from the inner circumference 34 of the magnet 24. Potential difference is therefore generated in the copper coil 22 when the magnet 24 is rotated thereabouts, said potential difference usable to charge the battery 36 and maintain a charge within the battery 36 such that the toe cap 44 is heatable when the temperature control 40 is activated, and portable electronic devices are usable interconnected with the plug connect 38 disposed upon the shoe 10, as desired. To protectively enclose the generator 20, a cap 70 is configured to removably and securely attach to the generator 20.

The present temperature controlled electric shoe 10 is thusly usable to cool the feet during hot weather, or in hot environments, by means of venting the shoe interior by action of the compressible heel section 66 forcibly transferring air through the air channel 46 into the shoe 10 interior (when the switch-valve 62 is in the open position and the two-valve is in the first vent position), and also to heat the feet during cold weather, or in cold environments, be means of the toe cap 44 producing heat from resistance of an electric current supplied thereto from the battery 36, which battery 36 charge is maintained by means of the electric generator 20 converting kinetic energy of the user to electrical energy usable to charge the battery 36. Moreover, portable electronics are interconnectable with the battery 36 in the shoe 10 by means of the plug connect 38 whereby a user may, for example, listen to music while working, charge a cell phone, or operate another small portable electronic device or accoutrement, as desired.

What is claimed is:

1. A temperature controlled electric shoe comprising:

a generator;

a battery in circuit with the generator;

a plug connect disposed on the exterior of the shoe, said plug connect in circuit with the battery;

a temperature control switch in circuit with the battery;

a plurality of wiring in circuit with the temperature control switch;

a steel toe in circuit with the wiring;

wherein the generator creates an electric current when a person wearing the shoe ambulates, said current charging the battery, whereby the steel toe is heatable when the temperature control switch is moved to a particular temperature setting and portable external electronic accoutrements are interconnectable in circuit with the battery by means of the plug connect;

means for venting air into the shoe, said means comprising:

an air channel disposed through the heel counter of the shoe, the sole, and the midsole;

an air intake disposed in open communication with the air channel, said air intake disposed within the heel counter;

at least one air outlet disposed in open communication with the air channel, said air outlet disposed open to the interior of the shoe;

an air vent in open communication with the air channel, said air vent configured to vent air from the air channel exterior to the shoe; and a switch-valve disposed upon the shoe, said switch-valve manually operable to route air within the air channel between an open position and a closed position;

wherein air is vented interiorly to the shoe when the switch-valve is moved to the open position and air is vented exteriorly from the shoe via the air vent when the switch valve is moved to a closed position.

2. The temperature controlled electric shoe of claim 1 further comprising a compressible heel section in baric communication with the air channel wherein ambulation compresses the heel section when weight is applied thereto, said heel section including a spring member disposed within the heel section, said spring decompressing said heel section when weight is removed therefrom, wherein the heel section moves between a compressed position and a decompressed position.

3. The temperature controlled electric shoe of claim 2 wherein the generator further comprises:

a copper coil;

a circular magnet rotatably disposed around the copper coil, said magnet including a crenate inner circumference;

a crank gear disposed to rotationally engage the magnet when a person wearing the shoe ambulates, said crank gear vertically moveable between a first position and a second position;

a spindle gear operationally engaged by the crank gear, said spindle gear centrally disposed within the magnet, said spindle gear comprising:

a central crenate cog rotationally engaged by vertical movement of the crank gear;

a plurality of spindle arms disposed upon the crenate cog, each of said spindle arms configured to directionally engage with the inner circumference of the magnet when the crank gear moves from the first position to the second position;

wherein the crank gear rotates the magnet within the copper coil when a person wearing the shoe ambulates to create a potential difference thereby, whence an electric current is conductible in circuit to charge the battery.

4. The temperature controlled electric shoe of claim 3 wherein air is drawn in through the air inlet when the heel is moved to the decompressed position.

5. The temperature controlled electric shoe of claim 4 wherein air is expelled through the air outlet when the heel is moved to the compressed position and the switch valve is in the open position, and air is alternately expelled exteriorly from the shoe through the air vent when the heel is moved to the compressed position and the switch valve is in the closed position.

6. The temperature controlled electric shoe of claim 5 wherein the crank gear is moved to the second position when the heel is moved to the compressed position and the crank gear is moved to the first position when the heel is moved to the decompressed position.

7. A temperature controlled electric shoe comprising:

a generator comprising:

a copper coil;

a circular magnet rotatably disposed around the copper coil, said magnet including a crenate inner circumference;

a crank gear disposed to rotationally engage the magnet when a person wearing the shoe ambulates, said crank gear vertically moveable between a first position and a second position;

a spindle gear operationally engaged by the crank gear, said spindle gear centrally disposed within the magnet, said spindle gear comprising:

a central crenate cog rotationally engaged by vertical movement of the crank gear;

a plurality of spindle arms disposed upon the crenate cog, each of said spindle arms configured to rotationally engage with the inner circumference of the magnet when the crank gear moves from the first position to the second position and disengage with said inner circumference when the crank gear moves from the second position to the first position;

a cap configured to removably securely enclose the generator;

a battery in circuit with the generator;

a plug connect disposed on the exterior of the shoe, said plug connect in circuit with the battery and usable to interconnect external electronic accoutrements in circuit with the battery;

a temperature control switch in circuit with the battery;

a plurality of wiring in circuit with the temperature control switch;

a steel toe in circuit with the plurality of wiring;

an air channel disposed through the heel counter of the shoe, the sole, and the midsole;

an air intake disposed in open communication with the air channel, said air intake having a one-way valve disposed within the heel counter;

at least one air outlet disposed in open communication with the air channel, said air outlet disposed within the insole of the shoe;

an air vent in open communication with the air channel, said air vent configured to vent air from the air channel exterior to the shoe;

a switch-valve disposed upon the shoe, said switch-valve manually operable between an open position and a closed position whereby air is vented alternately through the air outlet interiorly to the shoe when the switch-valve is in the open position and through the air vent exteriorly to the shoe when the switch-valve is in the closed position;

a two-way valve disposed in the air channel, said two way valve configured to route airflow within the air channel between the air outlet and the air vent when the switch-valve is respectively moved between an open position and a closed position;

a compressible heel section in baric communication with the air channel, said heel section compressible when weight is applied thereto, wherein the heel section is compressible to a compressed position position; and a spring a member disposed within the heel section, said spring member forcing said heel section from the compressed position to a decompressed position when weight is removed from the heel section;

wherein the crank gear is moveably engaged by means of the compressible heel section, the crank gear thereby rotating the magnet around the copper coil when a person wearing the shoe ambulates, to create a potential difference thereby, whence an electric current is conducted in circuit to charge the battery, whereby the toe cap is heatable when the temperature control switch is moved to a particular temperature setting; and wherein the air channel vents the shoe when the switch-valve is moved to an open position and air is drawn in through the air intake when the heel section is moved from the compressed position to the decompressed position and air is expelled out of the air outlet interiorly to the shoe when the heel is moved to the compressed position and the switch-valve is in the open position and alternately out of the air vent when the switch-valve is in the closed position.

* * * * *